United States Patent [19]

Winter

[11] 4,368,104

[45] Jan. 11, 1983

[54] INSPECTION HOLE COVER FOR COKE OVEN

[76] Inventor: William L. Winter, 10404 S. Highland Rd., Garfield Heights, Ohio 44125

[21] Appl. No.: 206,372

[22] Filed: Nov. 13, 1980

Related U.S. Application Data

[63] Continuation-in-part of Ser. No. 76,340, Sep. 17, 1979, abandoned.

[51] Int. Cl.[3] ..... C10B 25/00; C10B 25/24

[52] U.S. Cl. ..... 202/248; 202/250; 202/267 R

[58] Field of Search ..... 202/242, 244, 245, 246, 202/247, 248, 250, 251, 270, 267; 49/463; 220/215, 352; 126/190, 191, 192, 220; 48/124; 201/18; 110/173 R; 432/250

[56] References Cited

U.S. PATENT DOCUMENTS 2,920,017 1/1960 Limberg ..... 202/250

FOREIGN PATENT DOCUMENTS 523263 10/1928 Fed. Rep. of Germany ..... 202/251

*Primary Examiner*—Bradley Garris

*Attorney, Agent, or Firm*—Maky, Renner, Otto & Boisselle

[57] ABSTRACT

An inspection hole cover for coke ovens includes a bowl-shape shell made of a material having relatively low magnetic properties such as 300 Series stainless steel. The shell is filled with a suitable heat insulating material such as a hardened refractory filler or ceramic fiber. A closure member may also be provided at the open end of the shell for retaining the heat insulating material within the cover. Because the cover is relatively non-magnetic, it is not subject to inadvertent removal by magnetic lifts used in coking facilities. However, provision is made for lifting the inspection hole cover by a hook, and a method of making the cover is also disclosed.

14 Claims, 7 Drawing Figures

INSPECTION HOLE COVER FOR COKE OVEN

CROSS-REFERENCE TO RELATED APPLICATIONS

This application is a continuation-in-part of U.S. application Ser. No. 76,340, filed Sept. 17, 1979, now abandoned.

BACKGROUND OF THE INVENTION

This invention relates generally, as indicated, to inspection hole covers for coke ovens, also commonly referred to as flue caps, and more particularly to inspection hole covers or flue caps which are relatively non-magnetic, light in weight, well insulated, and of relatively long life.

Modern coking facilities used in the steel making industry normally include a battery of coke ovens arranged in side-by-side relation with combustion chambers interposed between pairs of ovens. Along the top of each oven are a plurality of spaced-apart charging holes for charging the ovens with coal, which charging holes are provided with covers during the coking process. A series of smaller diameter holes is also provided in the top of each combustion chamber for inspection purposes, i.e., for inspecting the adjacent oven walls for bulges, leaks, etc., as well as the combustion chambers themselves for obstructions or damage. Also, during the coking process, selected inspection hole covers are periodically removed to make temperature checks and immediately put back in place to prevent escape of the hot combustion gases and to preclude entry of foreign material into the combustion chambers.

In modern coking facilities, larry cars, operating between an overhead coal storage bin and the ovens on a track supported by the battery of ovens, are employed to charge the ovens. The larry cars are usually provided with charging hoppers corresponding in number to the number of charging holes of each oven. In addition, the larry cars are usually provided with a corresponding number of magnetic lifts for picking up and replacing the charging hole covers during the charging operation. Accordingly, the charging hole covers are magnetic to permit their removal by the magnetic lifts.

Heretofore, the inspection hole covers have been made from solid cast iron which has known magnetic properties. From time to time during charging of the ovens, the inspection hole covers have sometimes been inadvertently removed by the magnetic lifts resulting in their loss and/or inconvenience to the oven operators. In addition, the cast iron flue caps or inspection hole covers have been somewhat difficult to handle because of their weight and shape. Also, the cast iron inspection hole covers have been subject to corrosion with consequent reduction in their useful life.

SUMMARY OF THE INVENTION

It is accordingly a principal object of this invention to provide improved inspection hole covers not subject to the drawbacks of known inspection hole covers noted above.

Another object is to provide such inspection hole covers which are not subject to being inadvertently picked up by the magnetic lifts normally employed in coking facilities.

Another object is to provide such inspection hole covers which are relatively light in weight, well insulated, of relatively long life, and highly resistant to corrosion in coking oven environments.

In contradistinction to known inspection hole covers, the inspection hole covers according to the present invention comprise a bowl-shape shell made of a material having relatively low magnetic properties such as stainless steel which is not subject to inadvertent removal by magnetic lifts used in coking facilities for picking up and replacing the charging hole covers during the charging operation. The inspection hole covers are filled with a non-magnetic heat insulating material such as a hardened refractory material or ceramic fiber material to reduce heat loss through the cover.

If a hardened refractory material that will not break up when exposed to heat for long periods of time is used as the insulating material, the top of the shell may be left open, and an upwardly opening cavity may be provided in the exposed top surface of the refractory material through which a bar embedded at its ends in the refractory material transversely extends to permit lifting of the cover by a hook. The bar preferably extends diametrically across the cover and is welded at its opposite ends to the stainless steel shell thereby to provide an integrated cover construction.

If, on the other hand, the refractory filler used has a tendency to break up due to heat, or other looser type insulating materials such as ceramic fiber are used, a closure member is provided for retaining the insulating material within the shell. Preferably, the closure member consists of an annular plate also made of a relatively low non-magnetic material such as stainless steel. The outer diameter of the plate is slightly less than the inner diameter of the shell at the open end thereof where the plate is secured to the shell by a plurality of circumferentially spaced tack welds leaving a slight gap between the plate and shell around the periphery thereof except at the welds. The gap allows moisture to escape from the shell as the shell heats up during the coking operation, and also reduces the amount of heat transfer from the shell to the plate.

A pair of aligned slots may also be provided in the plate for engagement by a hook to permit lifting of the covers from the inspection holes. To preclude the insulating material from coming out through the slots, a cup is attached to the inside of the plate overlying the slots.

The method of forming the inspection hole covers according to the invention comprises the steps of stamping and shaping the shell to its bowl-shape, filling the shell with the desired insulating material, and if a closure member is provided, welding the closure member in place with a gap between the closure member and shell except at the welds. If a refractory filler is used which does not require a closure member, a bar is welded at its ends to the side wall of the shell prior to filling the shell with the refractory material. Also, before the refractory filler sets, a styrofoam spacer may be inserted around the bar to define a cavity in the filler. After the refractory material has hardened, the styrofoam spacer is removed, for example, by burning it out with a torch thus leaving the cavity for receipt of a hook or the like.

To the accomplishment of the foregoing and related ends, the invention, then, comprises the features hereinafter fully described and particularly pointed out in the claims, the following description and the annexed drawing setting forth in detail certain illustrative embodiments of the invention, these being indicative, however, of but a few of the various ways in which the principles of the invention may be employed.

DESCRIPTION OF THE PREFERRED EMBODIMENTS

Figure 1:
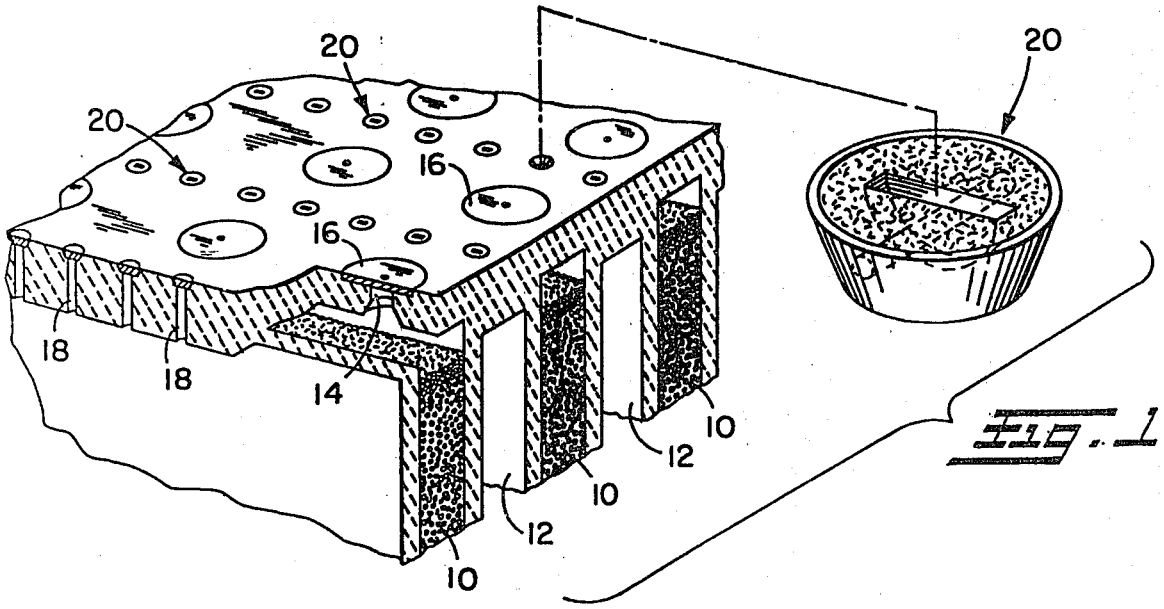
FIG. 1 is a fragmented perspective view of a coking facility of the type employing a battery of coke ovens and interposed combustion chambers with one form of inspection hole cover in accordance with the present invention illustrated in connection therewith.

Referring now to the drawing and initially to FIG. 1, thereof, a typical coking facility is shown in part to include a battery of coking ovens 10 arranged in side-by-side relation with combustion chambers 12 interposed between pairs of ovens. Each oven 10 is provided along its top with a plurality of spaced-apart charging holes 14 through which the oven is charged with coal. Each charging hole 14 is provided with a charging hole cover 16 which closes the charging hole during the coking process. Interposed between each bank of charging holes 14 is a bank of smaller diameter inspection holes 18 provided in the top of the combustion chambers for inspection of the combustion chambers and oven linings. Each hole 18 is provided with a removable inspection hole cover 20 which closes the hole 18 during the coking process.

Figure 2:
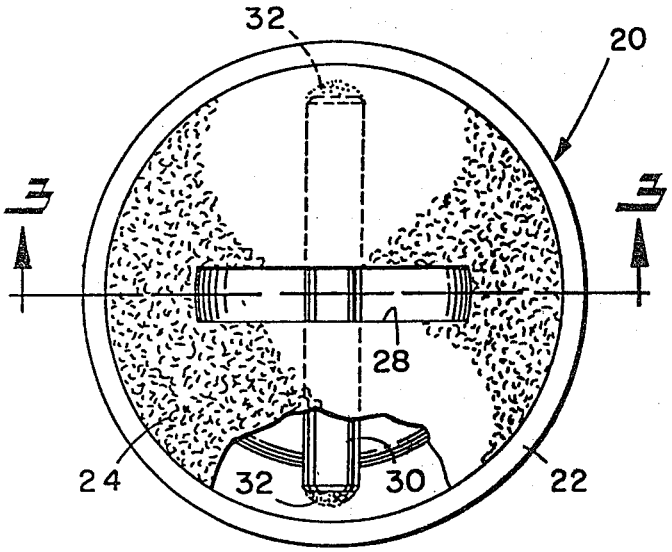
FIG. 2 is an enlarged top plan view of the inspection hole cover of FIG. 1.
Figure 3:
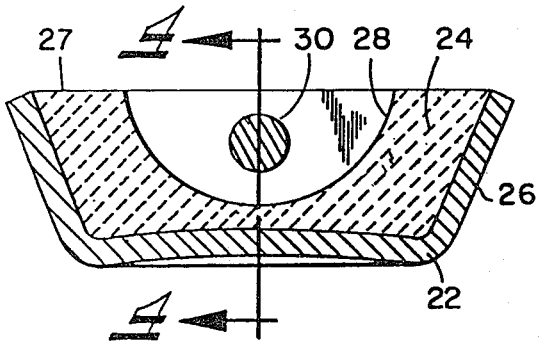
FIG. 3 is a transverse section through the inspection hole cover of FIG. 2, taken along the line 3—3 thereof.
Figure 4:
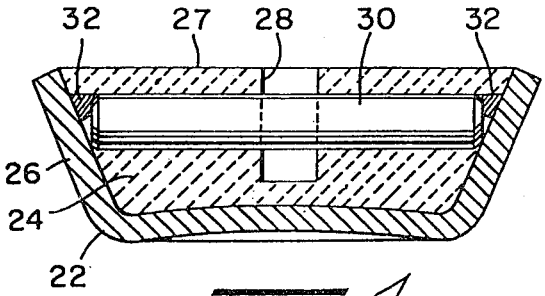
FIG. 4 is a transverse section through the inspection hole cover of FIG. 2, taken along the line 4—4 of FIG. 3.

Referring now additionally to FIGS. 2-4, it will be seen that the form of inspection hole cover 20 shown in FIG. 1 generally comprises a bowl-shape metal shell 22 having a generally flat base and an annular side wall 26 tapering outwardly from the base. The taper of the side wall 26 desirably substantially corresponds to the taper provided in the top of the inspection hole 18 for snug retention of the inspection hole cover in the hole when received therein, while still permitting easy removal of the cover for inspection and temperature checks as required. The shell 22 is preferably made of a suitable stainless steel such as 300 Series stainless steel having low magnetic qualities that will not permit it to be picked up by the magnetic lifts which are normally used for picking up and replacing the charging hole covers during the charging operation.

Contained within the shell 22 is a suitable non-magnetic heat insulating material 24 such as a hardened refractory filler or ceramic fiber. In the FIGS. 1-5 embodiment, a refractory filler is shown, which preferably is a high temperature resistant hydraulic bond insulating type capable of withstanding temperatures greater than 2000° F.

The refractory filler 24 desirably completely fills the shell 22 to present a flat, flush top surface 27 of the inspection hole cover, and is shown as having formed therein a cavity 28 which opens upwardly to the cover top surface. Extending transversely through the cavity is a bar 30 also preferably made of a relatively non-magnetic material such as stainless steel. The bar 30 has its ends embedded in the refractory filler and preferably extending diametrically across the inspection hole cover with its terminal ends secured to the side wall of the shell as by weldments 32. Such a construction securely locks the refractory filler in the shell thus providing an integrated cover structure, while the width and depth of the cavity 28 is made sufficient to allow insertion, for example, of a hook around the bar to permit lifting of the inspection hole cover thereby when the cover is too hot to pick up by hand.

Although it is preferred to employ the stainless steel shell 22 in the inspection hole cover 20, it is also contemplated that the cover could be made without the shell. In such instance, the cover would have a construction like that above but with the shell removed and the refractory body 24 having a bowl-shape external configuration similar to that of the shell for snug retention and ease of removal of the shell from the tapered inspection hole 18 when received therein.

Of course, in order for the shell to be eliminated, the refractory material must be capable of withstanding the heat that it is exposed to during the coking operation without breaking up. If the insulating material is susceptible to cracking, or other looser type insulating materials such as ceramic fiber are used in place of the refractory material, a closure member 40 of the type shown in FIGS. 6 and 7 may be provided at the open end 41 of the shell 22'. As shown, such closure member 40 desirably consists of an annular plate 42 also preferably made of stainless steel having relatively low magnetic properties disposed within the upper open end of the shell with a slight gap 44 therebetween around the periphery thereof except where the plate is secured to the shell as by a series of circumferentially spaced welds 46. The gap 44 allows any moisture within the cover to escape as the cover heats up during the coking operation, and also minimizes the transfer of heat from the shell to the closure member. Stainless steel is also a relatively poor conductor of heat for a metal, and because the covers are also filled with a heat insulating material, the loss of heat from the combustion chambers through the inspection hole covers is much less than through the inspection hole covers previously used.

Centrally of the closure member 40 is a pair of closely spaced slots 48 which may be formed in the annular plate 42 as by a piercing die or the like. The slots 48 permit the cover to be picked up by a hook or the like. To prevent insulating material from coming out of the cover through the slots, a cup-shape member 50 may be attached to the inside face of the plate overlying the slots. The cup is made from a circular plate also preferably of stainless steel and is stamped to shape including a central depression or well 52 providing sufficient clearance between the bottom of the plate and well for receipt of a hook within the slots, and an annular flat surface 54 surrounding the central well for flat engagement with the bottom of the plate and securement thereto as by two or more spot welds 56 or the like. The I.D. of the well 52 should of course be somewhat greater than the distance between the furthest ends of the two slots 48 so as not to obstruct the insertion of a hook therein, and the O.D. of the cup should be less than the O.D. of the plate 42 itself so as not to obstruct the gap 44 between the plate and shell. The O.D. of the plate, for example, may be approximately 8 inches to permit the same cup to be used for both a 10-inch and 12-inch diameter inspection hole cover.

According to the method of the invention, the inspection hole cover 20 or 20' is formed by first punching the shell 22 or 22' from a stainless steel plate and forming the same into its bowl-shape either in the punching operation or in a subsequent stamping or shaping operation. The shell once shaped forms a mold for receiving the insulating material which in the case of the refractory material may be poured into the shell in its fluid or semi-solid form for hardening after the bar 30 has been welded in place. Also, if a hydraulic bond type refractory material or the like is employed, heat may be provided to accelerate the cure.

Figure 5:
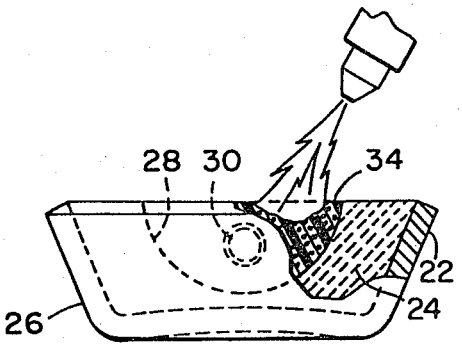
FIG. 5 is an elevation, partly sectioned, illustrating one way to remove the styrofoam spacer used to form a cavity in the filler material of the cover of FIGS. 1-4.

Before the insulating filler material sets or cures, a styrofoam spacer 34 may be inserted and positioned around the bar 30 to define the cavity 28 as shown in FIG. 5. The spacer 34 may be two pieces each being suitably relieved to accommodate the bar when the spacer is inserted into the hardened filler material. After cure of the filler material, the styrofoam spacer may then be burned out using a torch, thus leaving the cavity in the hardened refractory filler 24. Preferably, at least some filler materials is left between the bottom of the spacer and the shell 22 as seen in FIGS. 3–5 thereby to insulate the shell over the entire base thereof to enhance the insulating quality of the cover.

Figure 6:
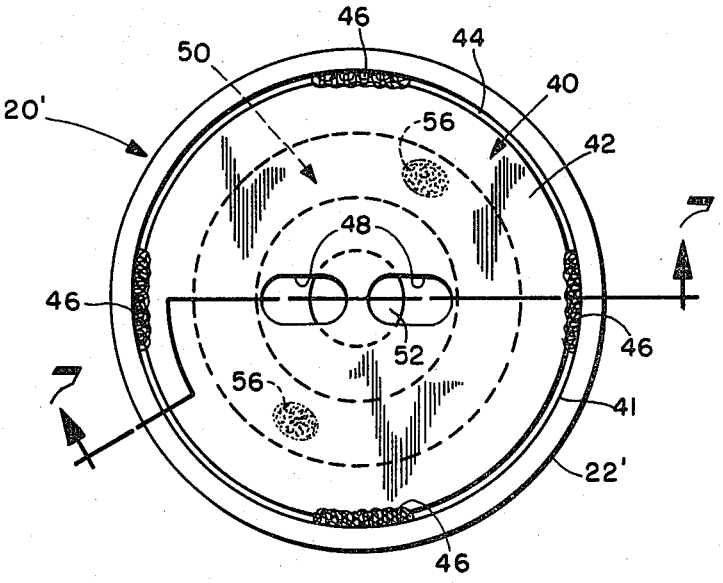
FIG. 6 is an enlarged top plan view of another form of inspection hole cover in accordance with the present invention.
Figure 7:
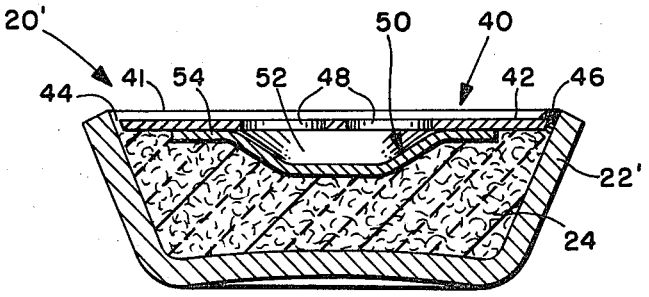
FIG. 7 is a transverse section through the inspection hole cover of FIG. 6, taken along the line 7—7 thereof.

When the closure member 20' is provided with a cover member 40 as shown in FIGS. 6 and 7, both the annular plate 42 and cup 50 are made from circular plates stamped to shape, and the two slots 48 are pierced in the plate 42 with a piercing die or the like. Next the cup 50 is spot-welded to the bottom side of the annular plate 42, and after the shell 22' has been filled with the desired insulating material, the closure member 40 is stitch-welded in place within the upper open end of the shell leaving the gap 44 between the closure member and shell except where the welds are.

It can now be appreciated that there is provided relatively lightweight, well insulated inspection hole covers having low magnetic properties so that they are not subject to inadvertent removal by magnetic lifts employed in modern coking facilities. In use, such inspection hole covers are much cooler and reduce heat loss therethrough much better than the cast or solid inspection hole covers previously used, and are also much less susceptible to sticking in the inspection holes than the inspection hole covers previously used. Also, such inspection hole covers have a relatively long life and are highly resistant to corrosion in coking oven environments.

Although the invention has been shown and described with respect to certain preferred embodiments, it is obvious that equivalent alterations and modifications will occur to others skilled in the art upon the reading and understanding of the specification. The present invention includes all such equivalent alterations and modifications and is limited only by the scope of the claims.

The embodiments of the invention in which an exclusive property or privilege is claimed are defined as follows:

1. An inspection hole cover for coking ovens comprising a bowl-shape metal shell having relatively low magnetic properties, said shell having a base and an annular sidewall tapering outwardly from said base, said shell being open at its upper end, and a high temperature resistant, non-magnetic insulating filler in said shell.

2. The cover of claim 1 wherein said shell is made of stainless steel.

3. The cover of claim 1 wherein said insulating filler is made of a hydraulic bond insulating refractory material.

4. The cover of claim 1 wherein said insulating filler is made of ceramic fiber.

5. The cover of claim 1 further comprising a transversely extending bar in said shell for permitting lifting of said cover by a hook, said filler having an upwardly opening cavity, and said bar extending into said cavity.

6. The cover of claim 5 further comprising a removable spacer in said shell for forming said cavity in said filler.

7. The cover of claim 5 wherein said filler consists of a hardened refractory material, and said bar is welded at least at one end to said shell, and said bar is embedded partially in said filler to assist in retaining said filler within said shell.

8. The cover of claim 1 further comprising a closure member disposed within said open upper end and secured in place for retaining said filler within said shell.

9. The cover of claim 8 wherein said closure member consists of an annular plate having an outer diameter somewhat less than the inner diameter of said open upper end of said shell to provide a gap therebetween except where said plate is secured to said shell at circumferentially spaced apart points around the periphery of said plate.

10. The cover of claim 9 wherein said plate is secured to said shell by a plurality of circumferentially spaced welds.

11. The cover of claim 9 further comprising a pair of slots in said plate for receipt of a hook to permit lifting of said cover, and a cup secured to the underside of said plate overlying said slots to prevent said filler from falling out of said cover through said slots.

12. The cover of claim 11 wherein said cup has a central well overlying said slots and a flat annular flange lying up against the underside of said plate, said cup being secured to said plate by spot welding said flange to said plate.

13. The cover of claim 1 wherein said shell is punched from a stainless steel plate and formed into such bowl-shape.

14. An inspection hole cover for use in coking ovens comprising a hardened refractory body having a bowl-shape external configuration, said body having a cavity opening to the top thereof, a bar embedded in said body extending transversely into said cavity whereby said cover can be lifted by engagement of said bar with a hook, and a bowl-shape shell of stainless steel surrounding the sides and bottom of said body, said shell being open at its upper end, and said bar being welded at its ends to said shell to lock said body in said shell.

* * * * *